United States Patent [19]

Becker et al.

[11] 4,455,033

[45] Jun. 19, 1984

[54] TORQUE TRANSMITTING LINKAGE FOR ARTICULATED VEHICLE

[75] Inventors: Heinz W. Becker, Winnipeg; Fred S. Whitfield; Dennis P. Chadwick, both of Napanee, all of Canada

[73] Assignee: Urban Transportation Development Corporation Ltd., Toronto, Canada

[21] Appl. No.: 352,231

[22] Filed: Feb. 25, 1982

[30] Foreign Application Priority Data

Feb. 26, 1981 [CA] Canada ..... 371784

[51] Int. Cl.[3] ..... B60D 7/00

[52] U.S. Cl. ..... 280/403; 105/3; 105/8 R; 280/461 R; 280/497

[58] Field of Search ..... 280/403, 461 R, 497; 296/1 R; 105/1 R, 3, 4 R, 8 R

[56] References Cited

U.S. PATENT DOCUMENTS

| | | | |
|---|---|---|---|
| 493,095 | 3/1893 | Knox | 105/8 R |
| 1,546,017 | 7/1925 | Herr | 105/3 |
| 2,843,417 | 7/1958 | Wahl et al. | 296/1 R |
| 2,863,400 | 12/1958 | Runken | 105/3 |
| 2,933,143 | 4/1960 | Robinson et al. | 280/461 R |
| 3,712,243 | 1/1973 | Pangalila | 105/1 A |
| 3,884,155 | 3/1975 | Maroshick | 105/4 R |
| 3,992,971 | 12/1975 | Maroshick | 105/4 R |

*Primary Examiner*—Joseph F. Peters, Jr.
*Assistant Examiner*—Kenneth R. Rice
*Attorney, Agent, or Firm*—Charles A. Blank

[57] ABSTRACT

An articulated vehicle includes a pivotal connection to permit movement between the chassis portions about a vertical and a horizontal axis. To reduce lateral deflection between the chassis portions a torque transmitting linkage is mounted at roof level and comprises a pivoted link mounted on a vertical pin on one of the chassis members. A pair of lateral links extend from the pivoted link to the other of the chassis members. The lateral links are generally parallel and prevent pivotal movement of the pivoted link upon a lateral force being applied to one of the chassis members.

9 Claims, 14 Drawing Figures

14

12

TORQUE TRANSMITTING LINKAGE FOR ARTICULATED VEHICLE

The present invention relates to articulated vehicles and in particular passenger carrying articulated vehicles such as street cars.

It is well known to articulate vehicles to enable them to negotiate a smaller radius curve than is available with a rigid chassis vehicle of comparable length. Conventionally such vehicles are articulated at the mid point of the vehicle so that the front and rear wheels of the vehicle follow the same curve.

In these passenger carrying vehicles it is generally desirable to have the two portions of the vehicle interconnected in a manner that allows movement of the passengers from one portion to another. This avoids the need for duplicate crew and entrance and exit doors. Such interconnection is usually achieved by means of a tunnel structure arranged at the articulation point to provide the required passageway. Such a tunnel structure must be designed to accommodate movement between the two vehicle portions while still providing an adequate passageway between the vehicles. The vehicle must be able to accommodate horizontal curves, that is steering movement about a vertical axis and vertical curves, that is a change of incline of the track being negotiated. There is also a tendency for the two halves of the chassis to oscillate about the longitudinal axis relative to one another due to an uneveness in the track or the spiralling of the track that is usually found at the start of a curve in a tracked vehicle. Such oscillation tends to cause lateral displacement between the two passenger carrying portions of the vehicle and this is generally undesirable where a passageway is used to connect the two vehicles. Such displacement is usually prevented by means of the bearing assembly which connects the two cars and permits the articulation between the cars. The forces which tend to produce the lateral displacement are reacted at this bearing to rigidly connect the cars about the longitudinal axis. However this requires the bearing structure to be relatively large and heavy in view of the magnitude of the forces imposed. Further this bearing structure is necessarily accommodated beneath the tunnel structure where space is at a premium.

It is therefore an object to the present invention to provide an articulated vehicle in which the above disadvantages are obviated or mitigated. According to the present invention there is provided an articulated vehicle comprising a first chassis and a second chassis, each having an outboard end and an inboard end, coupling means interconnecting said inboard ends and including vertical pivot means to accommodate relative movement of said chassis about a vertical axis for steering movement of said vehicle and horizontal pivot means to accommodate relative pivotal movement of said chassis about a transverse horizontal axis for relative vertical movement between said outboard ends, said coupling means further comprising torque transmitting means vertically spaced from said horizontal pivot means and operable to inhibit lateral movement between said chassis, said torque transmitting means including a first link pivotally connected to one of said chassis for movement about a vertical axis and a pair of transverse links extending between said one link and said other chassis and being connected thereto by vertical pivot connections to permit movement of said transverse links in a generally horizontal plane, said transverse links being connected to said first link at spaced locations whereby pivotal movement of said first link upon relative lateral displacement of said chassis is inhibited.

An embodiment to the invention will now be described by way of example only with reference to the accompanying drawings in which:

FIG. 1 is a general side view of an articulated street car,

FIG. 2 is a sectional elevation of the central portion of the street car shown in FIG. 1, FIG. 3 is a plan view of FIG. 2, FIG. 4 is a schematic plan view showing the linkage of FIG. 3 in different operating positions of the street cars with FIG. 4*a* showing the linkage with the cars in a straight horizontal position, FIG. 4*b* showing the street cars negotiating a horizontal curve and FIG. 4*c* showing the street cars negotiating a vertical curve.

Figure 2:
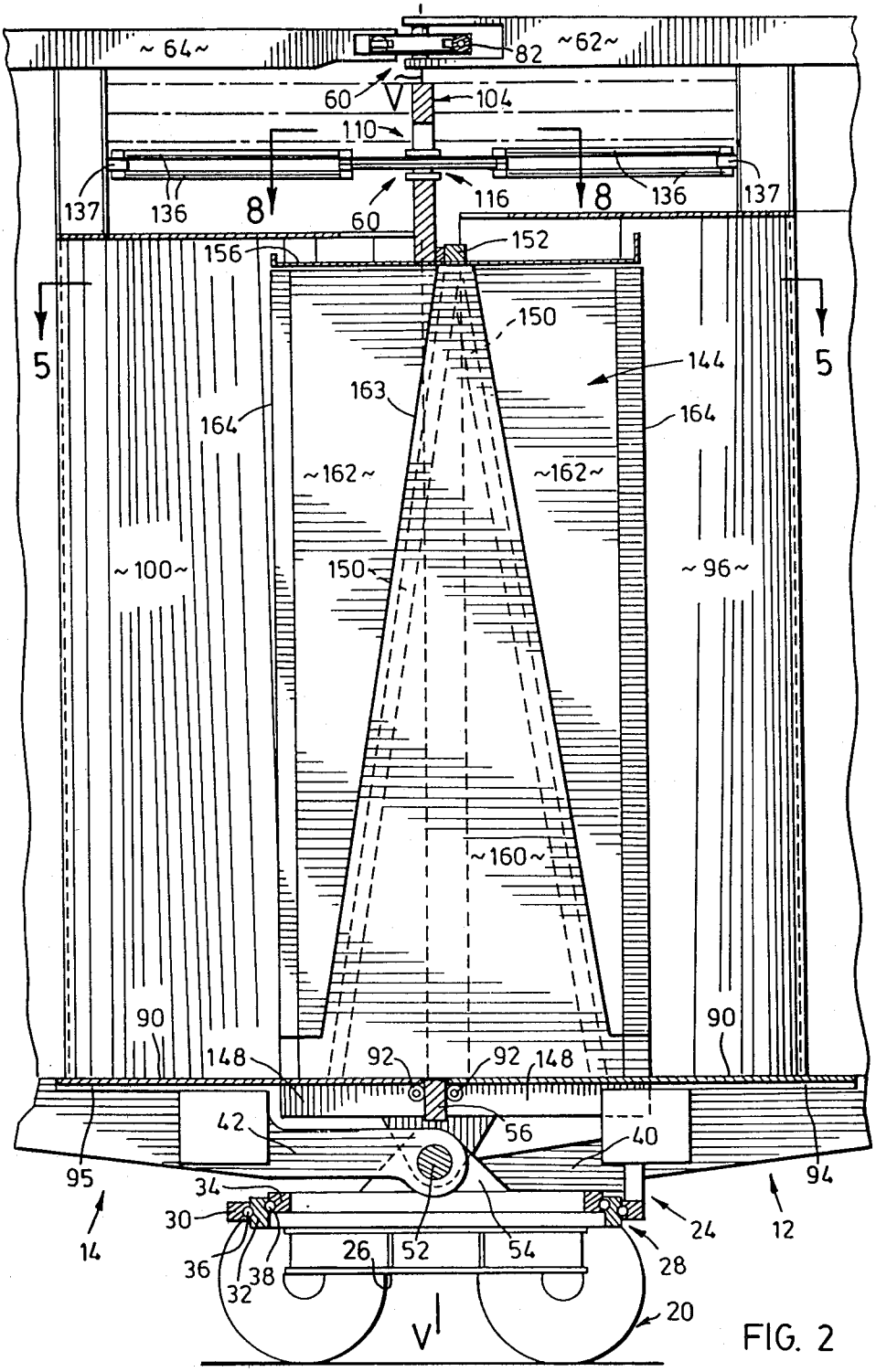
Figure 7C:
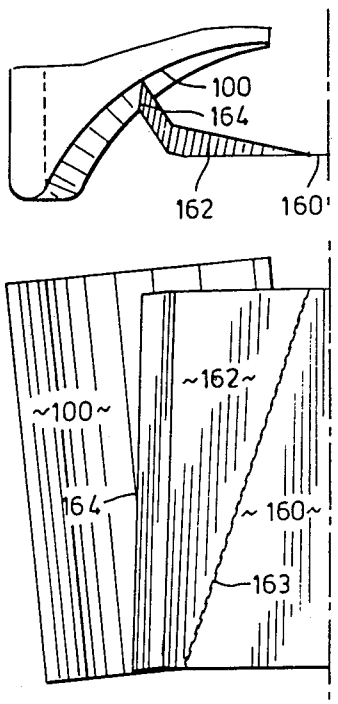
Figure 7B:
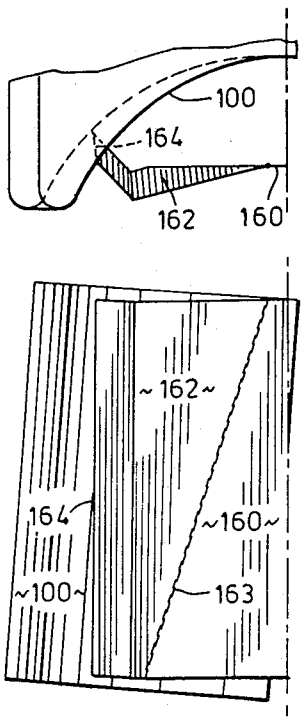
Figure 7A:
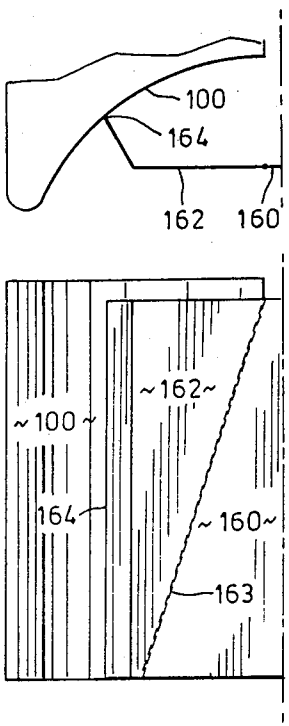
Figure 8:
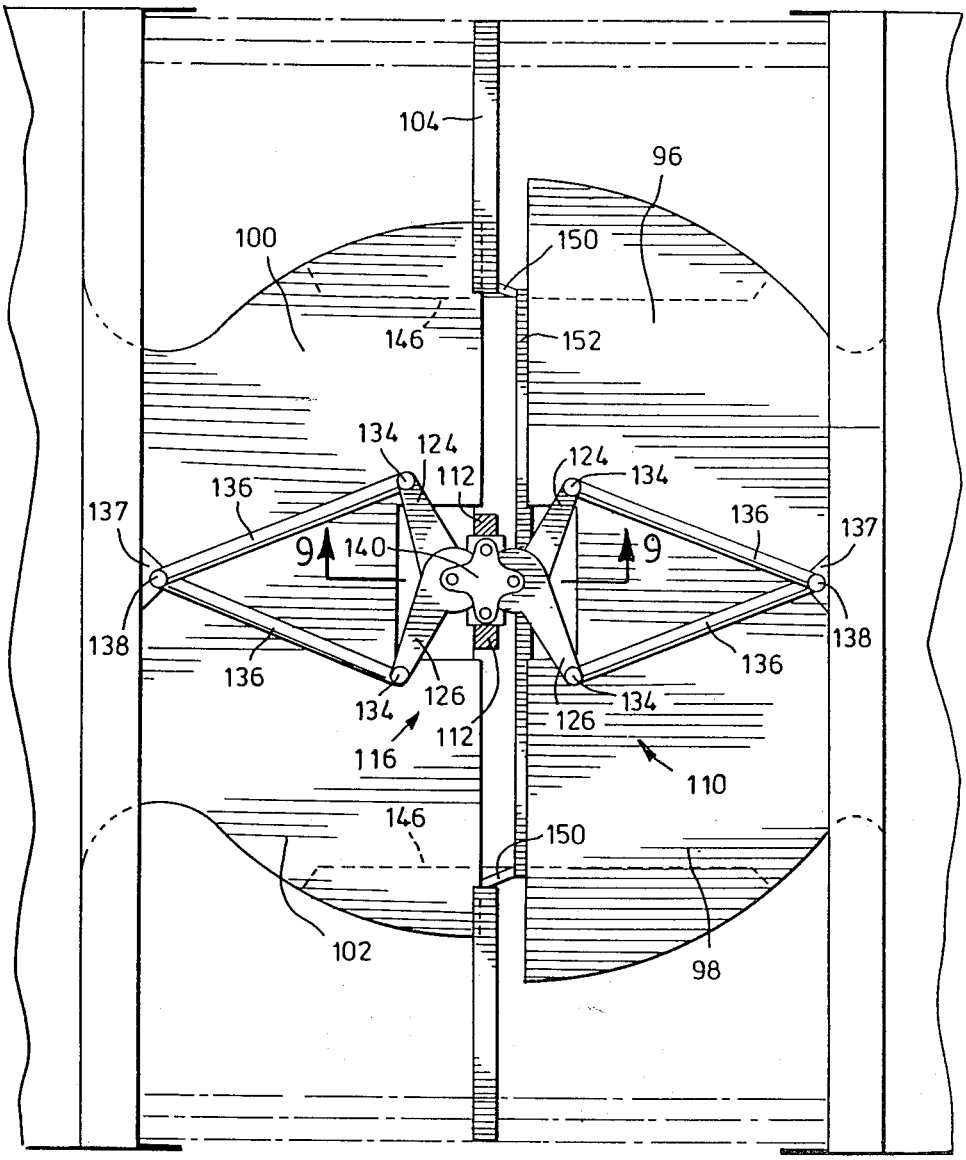

FIG. 7 is a series of diagrammatic representation showing in plan and elevation the operation of portions of the tunnel structure shown in FIG. 2 with FIG. 7*a* showing the street car in a generally horizontal disposition, FIG. 7*b* showing the street car negotiating a concave vertical curve and FIG. 7*c* showing the street car negotiating a convex vertical curve, FIG. 8 is a section on the line 8—8 of FIG. 2.

Figure 9:
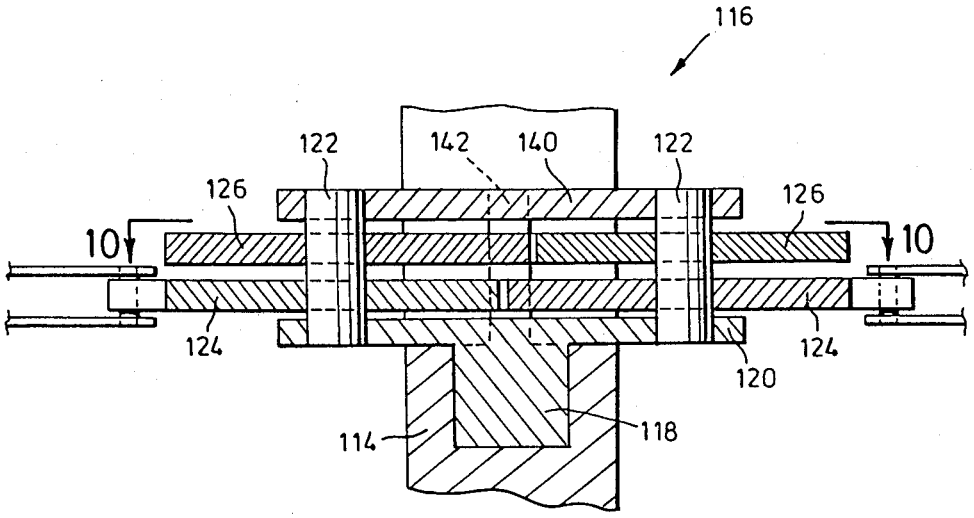

FIG. 9 is a section on the line 9—9 of FIG. 8.

Figure 10:
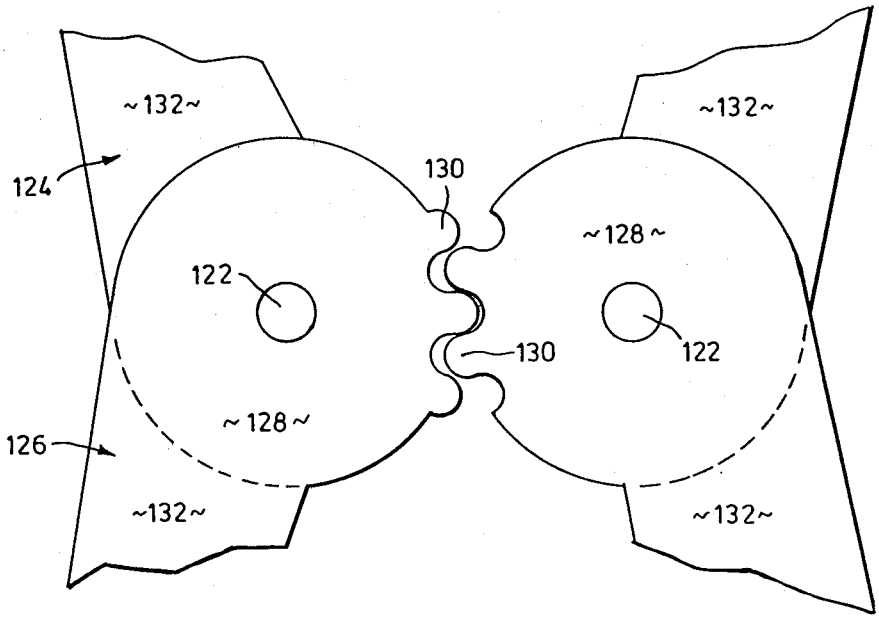

FIG. 10 is a view on an enlarged scale on the line 10—10 of FIG. 9.

Figure 1:
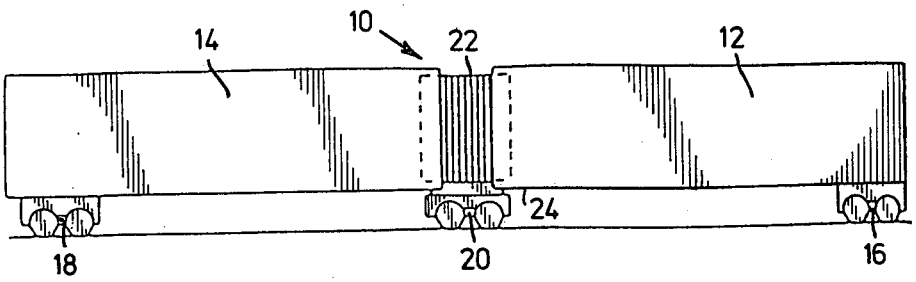

Referring now to the drawings and in particular FIG. 1, an articulated vehicle, in this case a street car, generally designated 10 comprises a leading car 12 and a trailing car 14. The cars 12 and 14 are supported on leading and trailing bogies 16, 18 respectively and by an intermediate bogie 20 positioned between the two cars. The intermediate bogie 20 also supports a tunnel structure generally designated 22 which interconnects the interiors of the two cars 12, 14 to allow movement of passengers between the cars. The cars 12 and 14 are connected to a turntable 24 to accommodate relative movement about a vertical axis designated VV on FIG. 2 to provide steering movement and about a horizontal axis designated H in FIG. 6 to accommodate changes in elevation.

Figure 5:
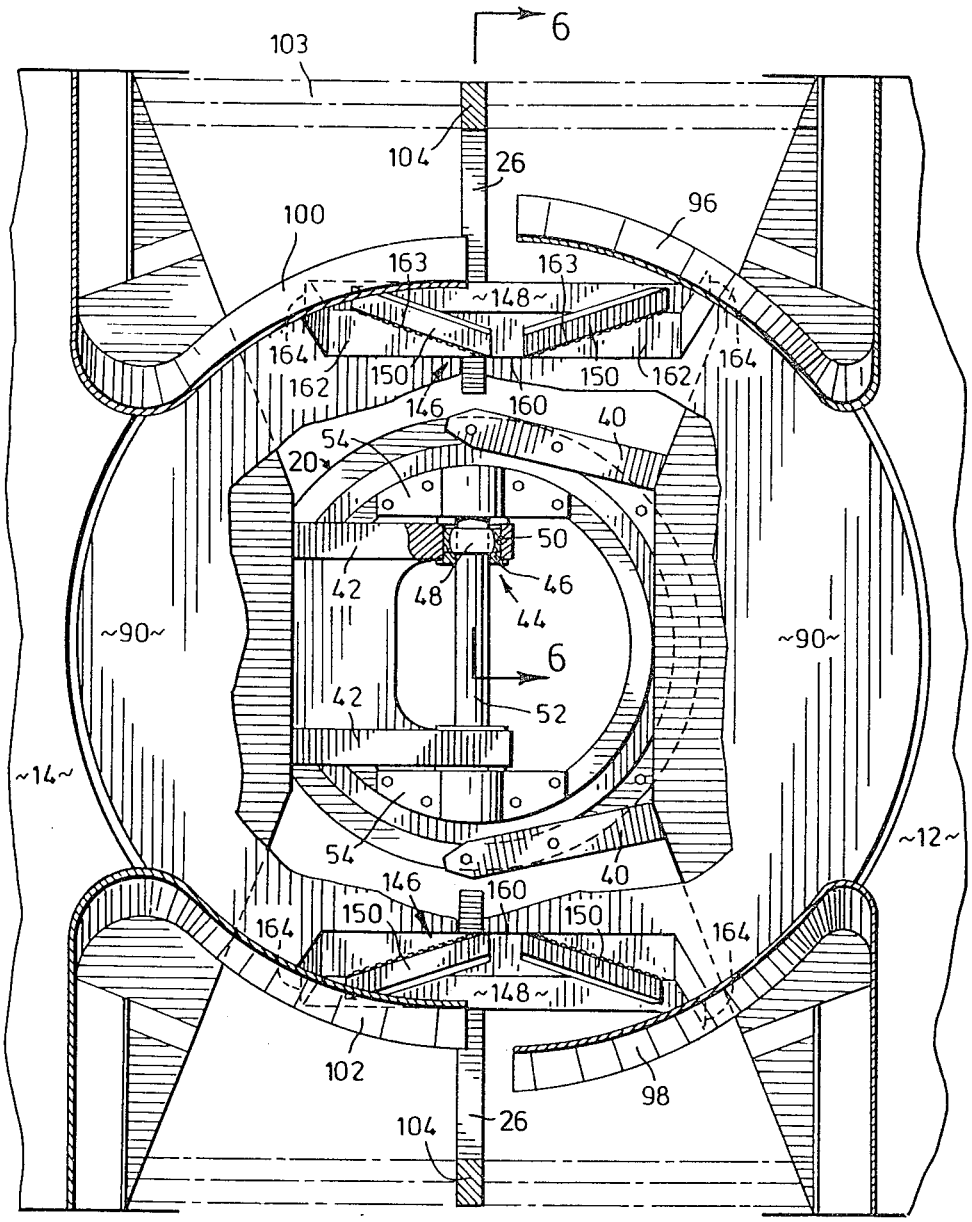
FIG. 5 is a section on the line 5—5 of FIG. 2

The details of the turntable 24 and the connection of the cars 12, 14 thereto can best be seen in FIGS. 2 and 5. The turntable 24 comprises of transverse bolster 26 to which are rotatably mounted the wheel sets of the bogie 20. A bearing assembly 28 is also mounted on the bolster 26 and comprises an outer ring 30, intermediate ring 32 and an inner ring 34. A pair of races 36, 38 connect the outer and intermediate and the inner and intermediate rings respectively. The rings 30, 32 and 34 may therefore rotate relative to one another about a generally vertical axis.

The intermediate ring 32 is connected to the transverse bolster 26. The leading car 12 is provided with a pair of support beams 40 which project rearwardly from the car below the general level of the passenger carrying compartment and are bolted to the outer ring 30. The trailing car 14 also includes a pair of support beams 42 which project forwardly from the car in spaced parallel relationship. The ends of the support beams 42 are bored to receive self-aligning bearing assemblies 44 which comprise an outer race 46 and an inner race 48. Each of the races has a spherical bearing surface so that the inner race can adopt a wide range of positions relative to the outer race. The inner race 48 is bored as indicated at 50 to receive a transverse shaft 52. The ends of the shaft 52 are supported in upstanding ears 54 which are bolted to the inner ring 34 of the bearing assembly 28. The two cars 12, 14 may therefore rotate relative to one another about a generally vertical axis which will result in relative movement between the inner and outer rings. At the same time, the self-aligning bearing assemblies 44 permit the trailing car 14 to rotate about a generally horizontal axis relative to the leading car and intermediate bogie to accommodate vertical curves.

Figure 3:
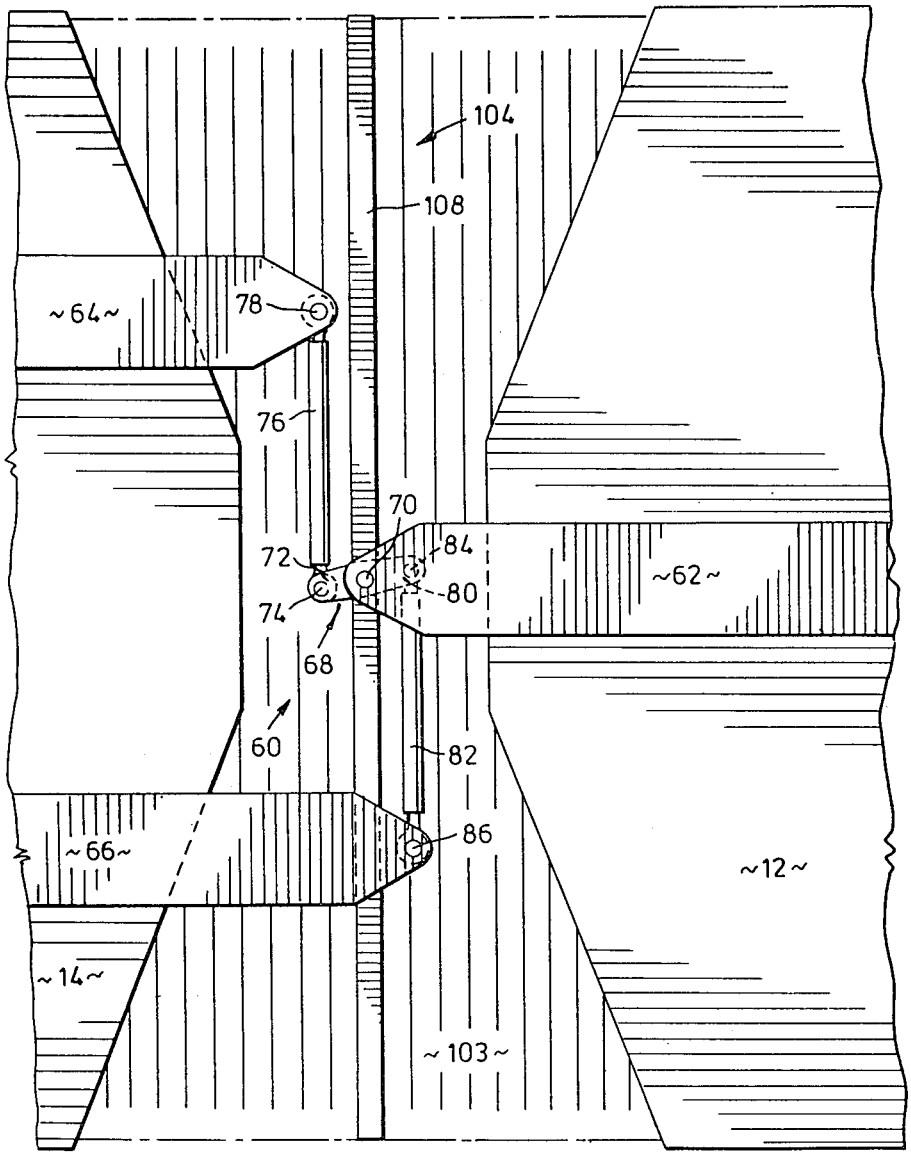

The cars 12, 14 are also connected at roof level by means of a torque resisting linkage generally designated 60. As can best be seen in FIG. 3, the leading car 12 includes a longitudinal beam 62 which projects rearwardly from the roof of the car 12 on the center line of the car. The trailing car 14 also includes a pair of longitudinal beams 64, 66 which are spaced to opposite sides of the center line of the car 14. The longitudinal beam 62 is pivotally connected to a cross-over link 68 by a pin 70 positioned midway along the link 68. One end 72 of the link 68 is pivotally connected by a connection 74 to a first transverse link 76. The link 76 is connected by a connection 78 to the beam 64. Similarly the other end 80 of the link 68 is connected by connection 84 to a second transverse link 82 which in turn is connected by a connection 86 to the beam 66. The first and second transverse links 76, 82 lie generally parallel to one another and the connections 74, 78, 84 and 86 are all arranged to permit pivoting movement about a generally vertical axis. The pin 70 is coincident with the vertical axis V of the turntable.

Figure 4A:
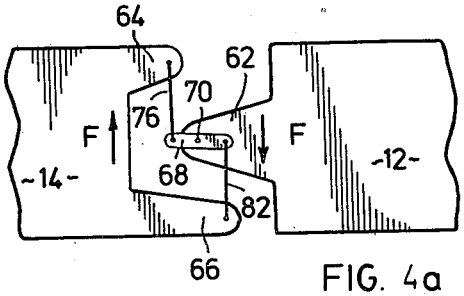
Figure 4B:
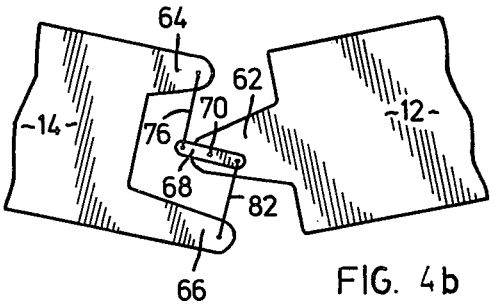
Figure 4C:
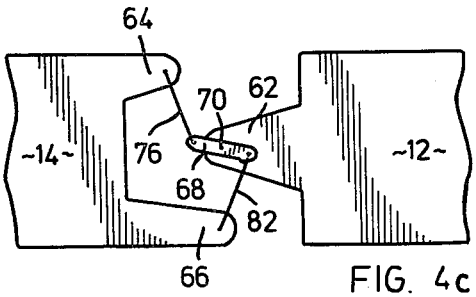

Upon the cars 12, 14 negotiating a horizontal curve, the cross over link 68 will rotate about the pin 70 to permit displacement of the cars 12, 14 about the vertical axis V. The orientation of the cross over link 68 with the transverse links 76, 82 remains constant so that a simple pivoting movement is achieved about the pin 70. This arrangement can best be seen in FIG. 4*b* in which the cars 12, 14 are negotiating a left hand curve. Upon the cars entering a vertical convex curve, the leading car will drop relative to the trailing car. This movement is accommodated about the transverse shaft 52 and causes a displacement in the position of the pin 70 relative to the rear car 14. This displacement is accommodated by pivotal movement of the transverse links relative to the support beams 64, 66 and by rotation of the cross over link 68 about the pin 70. Because the transverse links 76, 82 are substantially parallel and of equal length, the displacement of the connection 78 and 84 to either side of the center line of the vehicle is equal and opposite which is accommodated by rotation of the link 68 about the pin 70. This arrangement is shown in FIG. 4*c* in which it will be seen that the cross over link 68 is rotated in a clockwise direction about the pin 70 to allow the car 12 to rotate about the horizontal axis H relative to the trailing car 14. Thus the torque resistant linkage 60 does not inhibit the articulation of the cars about the horizontal and vertical axis.

Upon a force to cause lateral displacement between the cars 12, 14, due for example to an uneven track or to the banking of the track, the torque resistant linkage 60 operates to prevent relative displacement between the cars. The forces causing lateral displacement diagrammatically indicated by arrow F in FIG. 4*a* acts to move the longitudinal beam 62 toward one of the beam 64, 66. This would cause the pin 70 to move toward the beam, for example 66, so that the second transverse link 82 would tend to induce rotation of the cross over link 68 about the pin 70 in an anti clockwise direction. However, such rotation is resisted by the first transverse link 76 acting on the opposite side of the pin 70 so that the forces tending to laterally displace the cars 12, 14 are resisted by the linkage 60. Such forces are also resisted by transverse shaft 52 operating through the bearing assembly 28 so that the cars remain aligned on the center line of the vehicle. The provision of the roof mounted torque resisting linkage 60 enables the bearing assembly 28 to be designed to accommodate much smaller forces and would otherwise be the case.

Figure 6:
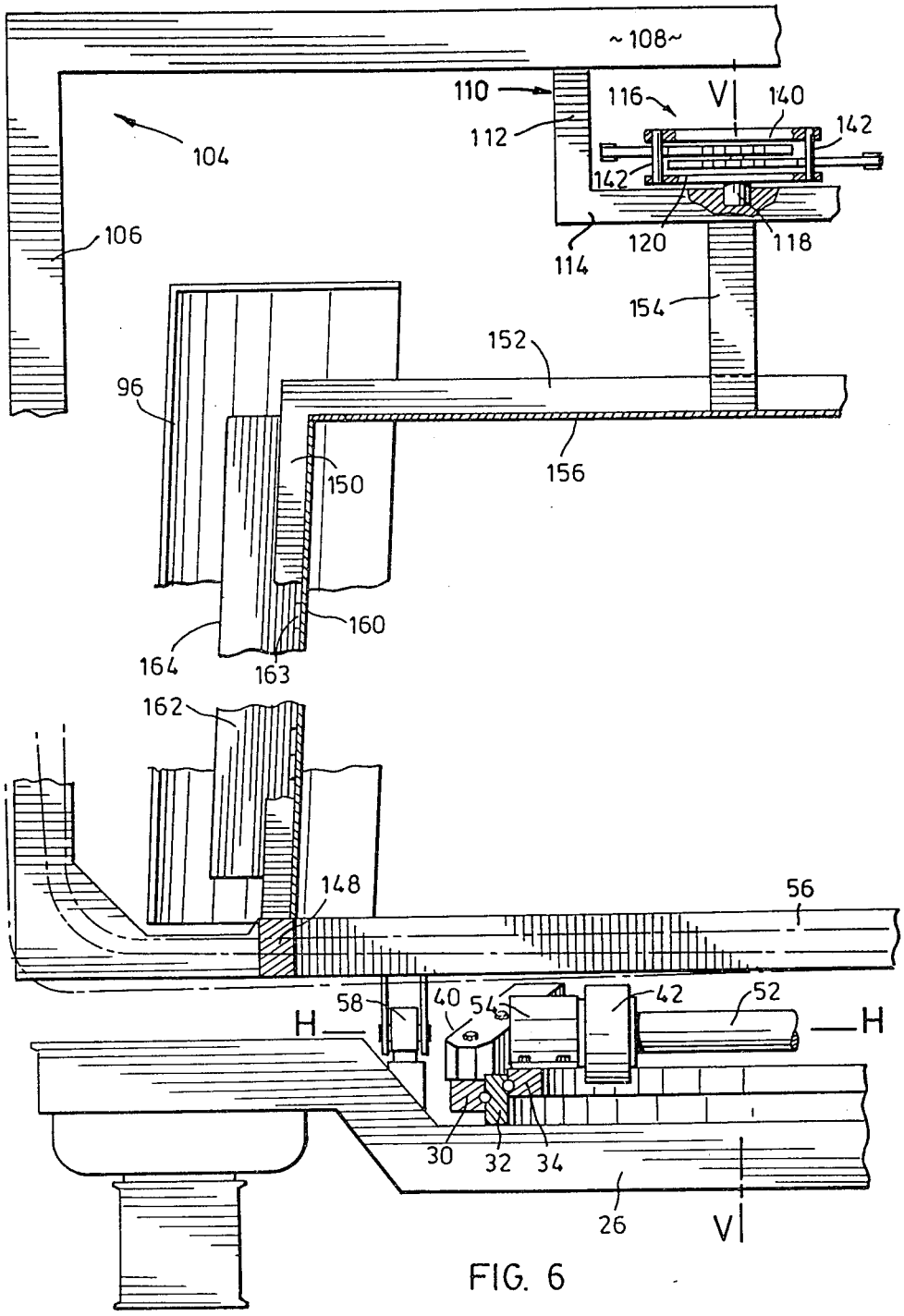
FIG. 6 is a section of the liner 6—6 of FIG. 5

The tunnel structure 22 is supported on a transverse beam 56 which is connected by pins 58 to the outer ends of the bolster 26 as seen in FIG. 6. The pins 58 permit the beam to rotate about generally horizontal axis to permit the tunnel structure to move back and forth along the longitudinal axis of the vehicle. The beam 56 also carries a pair of semi-circular floor plates 90 which are connected to the beam 56 by hinges 92. The periphery of the floor place rests on semi-circular recesses 94, 95 provided in the ends of the leading and trailing cars 12, 14 respectively. Upon rotation of the cars about the vertical axis, sliding movement between the floor plate 90 and the respective recess 94, 95 occurs and upon movement about the horizontal axis H, pivotal movement of the plates about the hinge 92 will occur. The periphery of the floor plates 90 is also covered by four part cylindrical shells 96, 98, 100, 102 which are connected in respective pairs to the leading and trailing cars 12, 14. The shells 96 to 102 define the entrance to the passageway between the cars and provide a smooth transition from the interior of the vehicle to the tunnel structure 22. It will be observed from FIG. 5 that the shells 96, 98 connected to the leading car 12 are of greater diameter than the shells 100, 102 connected to the trailing car 14. The shells are also inclined slightly to the vertical axis to provide a generally conical structure. The differing diameter of the shells permits them to overlap one another as the cars negotiate a horizontal curve.

The exterior of the cylindrical shells 96 to 102 is protected by a bellows 103 connected at opposite ends to the cars 12, 14 and supported intermediate th cars by a hoop 104. The hoop 104 is connected to the ends of the transverse beam 56 and includes a pair of vertical posts 106 and a horizontal beam 108. Depending from the horizontal beam is a hanger assembly 110 comprising a pair of vertical supports 112 and a cross beam 114. A centering mechanism generally designated 116 is pivoted on a shaft 118 to the cross beam for movement about a vertical axis.

The centering mechanism 116 is best seen in FIGS. 7 to 10 and comprises a base plate 120 rigidly connected to the shaft 118 for pivotal movement therewith. A pair of pivot pins 122 are mounted on the base plate 120 and each rotatably supports a pair of tooth levers 124, 126 respectively. Each of the levers 124, 126 comprises a circular head 128 having teeth 130 formed over a portion of the periphery of the head. A lever arm 132 is integrally formed with the head 128. The levers 124, 126 are arranged in pairs on each of the pivot pins 122 with the lever arms 132 extending in opposite directions on either side of the longitudinal axis of the vehicle. The spacing between the pins 122 is such that the teeth 130 of adjacent levers 124, 126 are meshed so that rotation of one of the levers about the pin 122 will induce equal and opposite rotation of the other lever about its pin 122. The extremities of each of the lever arms 132 are connected by vertical pivots 134 to struts 136. The struts 136 are connected to a mounting lug 137 on respective ends of the cars 12, 14 by means of a vertical pivot pin 138. A top plate 140 is mounted in spaced relationship from the base plate 120 and is secured to the base plate by pins 142.

Upon the cars 12, 14 rotating relative to one another about the horizontal axis H, the mounting lugs 137 will move either toward or away from each other to vary the distance between them. This movement is transmitted through the struts 136 and causes rotation of the respective two levers 124, 126 in opposite directions about the pins 122. Because the teeth 130 are in mesh, the equal and opposite rotation of the other pair of levers is induced which is only achieved if the cross beam 114 remains centered between the two lugs 137. Thus upon the cars 12, 14 negotiating a vertical curve, the centering mechanism 116 operates through the hanger assembly 110 to move the hoop 104 and the transverse beam 56 about the pins 58. In this way, the bellows remain centered between the two cars. Negotiation of a horizontal curve is accomplished by both of the links 124, 126 rotating about their respective pin 122 in the same sense, which is matched by equal and opposite displacement of the other pair of levers 124, 126. The centering mechanism therefore effectively rotates about the meshing teeth 130 to accommodate the horizontal curves.

A tunnel liner 144 is supported on the transverse beam 56 and by the hoop 104 to seal the area between the part cylindrical shells 96 to 102. The tunnel liner 144 includes a pair of side panels 146 which are connected to a pair of outriggers 148 mounted at opposite ends of the transverse beam 56. The side panels 146 are also supported by vertical posts 150 which converge to meet a horizontal roof truss 152. The roof truss 152 extends transversely across the tunnel liner 144 and is connected to a hanger 154 depending from the cross beam 114 of the hanger assembly 110. The side panels 146 are connected to a roof panel 156 which is also supported by the roof truss 152. The tunnel liner 144 therefore moves with the hoop 104 under the influence of the centering mechanism 116.

It will be noted that the tunnel structure 144 is displaced toward the leading car 12. This is to compensate for the different diameter of the shells 96, 98 and 100, 102 to equalise the spacing between side panels 146 and the adjacent shell.

It will be appreciated that as the street car 10 negotiates vertical curves, the side panels 146 and the cylindrical shells 90–102 will move relative to one another about the horizontal axis H. Under normal circumstances, such movement would cause the clearance between the panel 146 and the adjacent shell to vary along the height of the panel 146 due to the inclined line of contact of the panel 146 with the cylindrical surface of the shell. This has created a safety problem in that sufficient clearance must be left between the panels and the shells to allow for the maximum clearance which also results in a gap being left between the panels and the side walls to present a safety hazard. To overcome this problem, the side panels 146 are formed from a stationary portion 160 fixed to the outriggers 148 and to the roof panel 156. The stationary portion 160 is of a generally triangular shape with the base of a triangle supported by the outriggers 148 and with the apex adjacent the roof truss 152. A pair of triangular fillet panels 162 are hinged along the inclined edge 163 of the stationary portion so as to be pivotable about an axis running parallel to the inclined edge 163 of the stationary portion. The outer edges 164 of the fillet panels are jogged so as to lie at an acute angle with respect to the remainder of the side panels 146. The outer edges 164 are biased against the cylindrical shells 96 to 102 so as to follow the shells during relative movement between the cars 12, 14.

Upon the car negotiating a horizontal curve, the cylindrical shells slide within one another at each side and the line of contact between the shells and the outer edges of the fillet panels 162 remains substantially vertical. However, upon the vehicle negotiating a convex vertical curve, the two cars rotate about the horizontal axis H which causes the upper edges of the cylindrical shells 96 to 102 to move away from each other. The movement of the upper edge of the shells is greater than that of the lower edge and due to the cylindrical nature of the shells 96 to 102, the distance between the top edge of the side panel 146 and its respective liner and the lower edge of the side panel 146 and its respective liner will be greater than the distance of the bottom edge of the side panel and the liner. However by hinging the fillet panels 162 along an inclined edge, for a given angular displacement of the fillet panel relative to the stationary portion 160, the upper edge of the fillet panel will move a greater distance laterally than the lower edge. This therefore compensates for the variation in lateral spacing and enables the fillet panels to closely follow the walls of the shells and maintain an effective seal at all times. This in fact is shown in FIG. *7c* and the converse situation where the vehicle negotiates a concave vertical curve is shown in FIG. *7b*. It has been found that by adopting the inclined hinged panels, the gap between the panels and the cylindrical shells can be effectively sealed at all times and therefore reduce the risk of entrapment of part of one of the passengers during movement of the vehicle.

We claim:

1. An articulated vehicle comprising a first chassis and a second chassis, each having an outboard end and inboard end, coupling means interconnecting said inboard ends ad including vertical pivot means to accommodate relative movement of said chassis about a vertical axis for steering movement of said vehicle and horizontal pivot means to accommodate relative pivotal movement of said chassis about a transverse horizontal axis for relative verticle movement between said outboard ends, said coupling means further comprising torque transmitting means vertically spaced from said horizontal pivot means and operable to inhibit lateral movement between said chassis, said torque transmitting means including a first link pivotally connected to one of said chassis for movement about a vertical axis and a pair of transverse links extending between said first link and said other chassis and being connected thereto by vertical pivot connections to permit movement of said transverse links in a generally horizontal plane, said transverse links being connected to said first link at spaced locations whereby said transverse links oppose pivotal movement of said first link to inhibit relative to lateral displacement of said first and second chassis.

2. An articulated vehicle according to claim 1 wherein said first link is pivoted to said one chassis intermediate the ends of said first link and said transverse links are connected to said first link on opposite sides of said pivotal connection.

3. An articulated vehicle according to claim 2 wherein said transverse links are substantially parallel to one another and extend transversly on opposite sides of said first link.

4. An articulated vehicle comprising a first chassis and a second chassis, each having an outboard end and inboard end, coupling means interconnecting said inboard ends and including vertical pivot means to accommodate relative movement of said chassis about a vertical axis for steering movement of said vehicle and horizontal pivotal means to accommodate relative pivotal movement of said chassis about a transverse horizontal axis for relative vertical movement between said outboard ends, said coupling means further comprising torque transmitting means vertically spaced from said horizontal pivot means and operable to inhibit lateral movement between said chassis, said torque transmitting means including a first link pivotally connected intermediate its ends to one of said chassis for movement about a vertical axis and a pair of transverse links connected to said first link on opposite side of its connection to said one chassis, said transverse links extending between said first link and said other chassis and being connected to said first link and said other chassis by vertical pivot connections to permit movement of said transverse links in a generally horizontal plane.

5. An articulated vehicle according to claim 4 wherein said links extend in opposite transverse directions from said first link.

6. An articulated vehicle according to claim 5 wherein said transverse links are parallel to one another.

7. An articulated vehicle according to claim 6 wherein the pivot connection of said first link to said one chassis is concentric with said vertical axis whereby upon steering of said vehicle said first link rotates relative to said one chassis.

8. An articulated vehicle according to claim 7 wherein each of said chassis carries a vehicle body and said coupling means is located adjacent the floor of said body and said torque transmitting means is located adjacent the roof of said body.

9. An articulated vehicle according to claim 8 wherein said first link is pivotally mounted on a beam extending from the roof of the vehicle body of said one chassis and each of said transverse links is connected to a respective one of a pair of laterally spaced beams extending from the roof of the body of the other chassis.

* * * * *